US012515093B2

(12) United States Patent
Johnson et al.

(10) Patent No.: US 12,515,093 B2
(45) Date of Patent: Jan. 6, 2026

(54) JUMP ROPE HANDLE WITH AB ROLLER AND PUSH-UP DISC

(71) Applicants: James D. Johnson, Louisville, KY (US); Da'Vi R. Johnson, Louisville, KY (US)

(72) Inventors: James D. Johnson, Louisville, KY (US); Da'Vi R. Johnson, Louisville, KY (US)

( * ) Notice: Subject to any disclaimer, the term of this patent is extended or adjusted under 35 U.S.C. 154(b) by 61 days.

(21) Appl. No.: 18/227,145

(22) Filed: Jul. 27, 2023

(65) Prior Publication Data

US 2025/0032846 A1 Jan. 30, 2025

(51) Int. Cl.

| | |
|---|---|
| ***A63B 5/20*** | (2006.01) |
| ***A63B 21/00*** | (2006.01) |
| ***A63B 21/072*** | (2006.01) |
| ***A63B 23/02*** | (2006.01) |
| ***A63B 23/12*** | (2006.01) |

(52) U.S. Cl.

CPC ..... *A63B 21/4035* (2015.10); *A63B 5/20* (2013.01); *A63B 21/072* (2013.01); *A63B 23/0205* (2013.01); *A63B 23/1236* (2013.01)

(58) Field of Classification Search

CPC ..... A63B 5/50; A63B 23/1236

See application file for complete search history.

(56) References Cited

U.S. PATENT DOCUMENTS

| | | | | |
|---|---|---|---|---|
| 2,719,038 | A | 9/1955 | Massa | |
| 4,101,123 | A | 7/1978 | Anthony | |
| 4,579,337 | A | 4/1986 | Uyeda | |
| 4,801,137 | A | 1/1989 | Douglass | |
| 4,893,810 | A | 1/1990 | Lee | |
| 5,163,887 | A | 11/1992 | Hatch | |
| 5,295,934 | A | 3/1994 | Collins et al. | |
| 7,585,262 | B1 * | 9/2009 | Vayntraub | A63B 21/4035 482/141 |
| 2012/0258847 | A1 * | 10/2012 | Lafferty | A63B 26/003 482/141 |
| 2015/0328491 | A1 * | 11/2015 | Miller | A63B 21/4025 482/121 |
| 2018/0043213 | A1 * | 2/2018 | Poeschl | A63B 26/00 |
| 2018/0353811 | A1 * | 12/2018 | Tam | A63B 1/00 |
| 2018/0368738 | A1 * | 12/2018 | Tong | A63B 21/0552 |
| 2019/0030390 | A1 * | 1/2019 | Chuang | A63B 21/0004 |
| 2019/0030391 | A1 * | 1/2019 | Chuang | A63B 23/0205 |
| 2021/0023413 | A1 * | 1/2021 | Nurge | A63B 21/4034 |
| 2021/0178217 | A1 * | 6/2021 | Ix | A63B 21/4035 |

* cited by examiner

*Primary Examiner* — Joshua T Kennedy

(74) *Attorney, Agent, or Firm* — CARRITHERS LAW OFFICE, PLLC; David W. Carrithers

(57) ABSTRACT

A combination jump rope with a removable handle assembly including a stirrup hand guard including a dome shaped push-up disc extending from the outside edge of a hand guard opposite the hollow handle having a removable end cap, a bearing member disposed within the outer end of the handle defining ab roller for stomach exercises, a retainer for attaching the jump rope to an end of the handle opposite the bearing member, and weights for insertion inside the hollow handle.

14 Claims, 5 Drawing Sheets

JUMP ROPE HANDLE WITH AB ROLLER AND PUSH-UP DISC

TECHNICAL FIELD

The present invention relates to the field of exercise equipment using weighted jump rope handles for multiple exercise and fitness routines.

BACKGROUND OF THE INVENTION

The present invention relates to exercise equipment, more particularly to a combination jump rope with a handle including a dome shaped push-up disc extending from the outside edge of a hand guard and a ball bearing disposed within the outer end of the handle defining an abdominal ("AB") roller for stomach exercises.

Weights are used for a myriad of fitness and athletic training purposes. Different types of jump ropes are used for particular training sessions, each of which has particular advantages and disadvantages.

One type of jump rope uses interchangeable weighted handles; however, the handles are specific for a particular jump rope and do not allow use of conventional barbell type weights. Another type of jump rope has a specific amount of weight permanently attached to a handle.

Devices to lock weights onto barbell handles are well known in the prior art. For example, U.S. Pat. No. 5,295,934 is directed to a collar and sleeve arrangement for holding weights onto the handle of a barbell. Spheres mounted in the collar lock into grooves on the barbell handle to hold the collar in place. The collar is released by compressing flanges extending from the separate sleeve and collar pieces toward one another. U.S. Pat. No. 5,163,887 also discloses a collar and sleeve arrangement, but the device taught by this patent is released from the handle by twisting the outer collar relative to the sleeve so that steel balls riding against the sleeve are rotated into deeper grooves within the collar. U.S. Pat. No. 4,893,810 discloses a sleeve and collar that is released by pulling on a flange extending from the device's sleeve. U.S. Pat. No. 4,579,337 discloses a sleeve and collar device that is threaded together, such that twisting the sleeve relative to the collar disengages a locking ball.

Each of the aforementioned patents are directed to a sleeve and collar arrangement used to secure weight units to a handle. The sleeve and collar arrangements are separate from the weights which they secure to the handle.

Jump ropes, like dumbbells, are also used for many fitness and training purposes. For safe and efficient exercise, the length of the jump rope must be precisely fitted to its user. Maintaining numerous jump ropes in varying lengths to accommodate different users can be expensive. Therefore, a jump rope whose length is adjustable for each user is desirable. To reduce twisting of the rope, a jump rope may ride on ball bearings in the handles so that it rotates freely. Furthermore, a fitness benefit could be derived by allowing the user to vary the amount of weight integrated into the jump rope handles. Variable-weight handles allow the jump rope to be used for different purposes and by persons of varying levels of fitness.

Jump ropes featuring ball bearings to reduce wear on the rope and to enable quicker and smoother jumping are well known in the prior art. U.S. Pat. No. 4,101,123 discloses such a jump rope.

Jump ropes with variable-weight handles are also well known in the prior art. U.S. Pat. No. 2,719,038 discloses a jump rope with a means for bolting weights between the handle and rope. U.S. Pat. No. 4,801,137 discloses a jump rope whose handles are hollow to receive weights internally. The weights are of variable length, and thus must be held in place by a spring in a cap on the end of the handle.

The present jump rope invention allows the user to attach different amounts of weight to its handle, thereby allowing the continued use of the same handle as the amount of weight required changes.

None of these patents therefore teach a device in which a jump rope handle incorporates a ball bearing rotationally disposed in the distal end of the handle for AB exercises. Moreover, the ball bearing can be spring loaded to a particular tension. None teaches a handle having a convex weight positioned on the outer surface of the stirrup shaped handle guard which is in alignment with the user's wrist and arm to be used as a push-up disc having a selected weight formed integral with the handle or including a detachment means such as snap lock, or threaded fit to a base to change out the weights.

SUMMARY OF THE INVENTION

The present invention comprises a combination jump rope with a weighted handle including a dome shaped push-up disc extending from the outside edge of a hand guard and a ball bearing roller disposed within an outer end of the handle defining an AB roller for stomach exercises.

An exercise and fitness device comprising or consisting of a pair of longitudinal handles with each longitudinal handle having a hollow interior and having a first end cap affixed to a first distal end and second end cap affixed to a second distal end. A jump rope has a first distal end removably retained to the first end cap of each of the longitudinal handles by a retaining means. A handle guard defining a stirrup has distal ends mounting to opposing distal ends of the longitudinal handle. At least one weight disposed within the hollow interior of the longitudinal handle. At least one convex shaped base of a selected size is affixed to an outer surface of the handle guard in opposed alignment to the user's wrist and forearm. A bearing member extends from the second end cap of the longitudinal handle.

A combination jump rope and handle assembly including a stirrup handle guard includes interchangeable weight units allowing for various weights to be easily disposed within the handles grips and dome shaped base plates extending from the outer edge of the handle stirrup providing support for push-ups. Moreover a ball bearing disposed in the distal ends of the handle provides a means for abdominal muscle exercise. The ball bearings may be spring loaded, fixed, or composed of a resilient material or material of a selected hardness for massaging the ABS. The jump rope is treaded through a loop formed in an end of the handle. The locking attachment which holds the weight onto the handle simply relies on friction to hold the weight in place.

The exercise and fitness jump rope handle assembly device comprises or consists of a pair of longitudinal handles including a hand guard defining a stirrup, wherein each longitudinal handle is generally cylindrical and hollow defining a first and second end. A jump rope includes a means for attaching the rope to the handle such as a retainer means, loop, or ring fitting to or extending from the distal ends of the longitudinal handle which extends through the handle. A handle guard defines a stirrup having distal ends mounting to opposing distal ends of said handle. At least one convex shaped dome of a selected size and weigh is affixed to an outer surface of the stirrup of the handle guard in opposed alignment to said user's wrist and forearm. Each one of said longitudinal handles define a hollow cylinder which contains a selected weight disposed with the hollow cylinder including a top secured thereto by a friction fit or the cap may be threadably affixed to the top of a threaded hollow cylinder. The distal end of the hollow cylinder or the cap optionally includes spherical bearing member such as a ball bearing disposed in a distal end thereof, for instance in a socket, allowing a selected end of the handle to function as an abb roller.

More particularly, the combination jump rope and weight exercise and fitness device, comprises pair of handles, each handle being hollow and having a first and second end, a jump rope, a handle guard defining a stirrup having distal ends mounting to opposing distal ends of the handle, at least one convex shaped base member of a selected size and weigh affixed to an outer surface of the handle guard in opposed alignment to the user's wrist and forearm, and each one of the handles including a spherical bearing member disposed in a distal end thereof.

It is an object of the present invention to provide a portable gym device which functions as a jump rope with handles providing a pushup base, the handles forming a walking weight, the handles forming a boxing weight, and the handles forming an abb roller, wherein the jump rope handles include an interchangeable weight and the jump rope is detachable and reattachable.

It is an object of the present invention to provide for a jump rope exercise device including a selected fixed variable weight in a handle which includes a hand stirrup hand guard having a convex shaped weight affixed to an opposing outer surface of a stirrup shaped hand guard in order to be used for pushups.

It is an object of the present invention to provide for a variable weight jump rope that allows weights to be changed quickly and easily so that exercise is not significantly interrupted by the weight-changing process by insertion of weights into the hollow jump rope handles.

It is a further object of the present invention to provide for a jump rope that allows the user to easily and quickly adjust the length of rope to fit that particular user by attaching the rope to retaining means affixed to the distal end of the handle such as a loop, ring, or knob extending therefrom.

It is an object to incorporate a ball bearing in the distal end of the jump rope handle for abdominal exercises.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
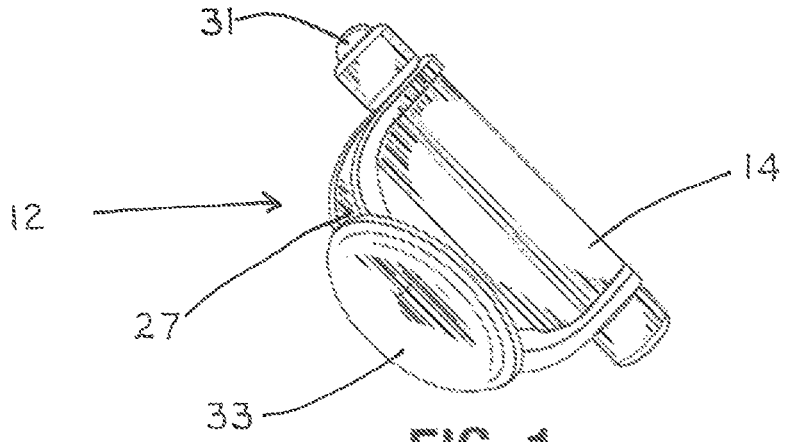
FIG. 1 is a perspective view of the jump rope handle assembly of the present invention.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, the term "about" can be reasonably appreciated by a person skilled in the art to denote somewhat above or somewhat below the stated numerical value, to within a range of +10%.

The information included in this section, data or specifications, including any references cited herein and any description or discussion thereof, is included for exemplary purpose only and is not to be regarded as subject matter by which the scope of the invention as defined in the claims appended hereto is to be bound.

The following text sets forth a broad description of numerous different embodiments of present disclosure. The description is to be constructed as exemplary only and dose not describes every possible embodiment since describing every possible embodiment would be impractical if not impossible. It will be understood that any feature, characteristic, component, composition, ingredient, product, step or methodology described herein can be deleted, combined with or substituted for, in whole or part, any other feature, characteristic, composition, ingredient, product, step or methodology described herein. Numerous alternative embodiments could be implemented, using either current technology or technology developed after the disclosure date of the invention.

The description of the exemplary embodiments according to principles or spirits of the present invention is intended to be read in connection with the accompanying drawings, which are to be regarded as part of the entire written description. In the description of the embodiments of the invention disclosed herein, for describing precisely and concisely, each element in the drawings is assigned a reference number in most cases in term of its feature corresponding the claims append unless expressly described otherwise.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

For the purposes of promoting an understanding of the principles of the invention, reference will now be made to the embodiment illustrated in the drawings and specific language will be used to described the same. It will nevertheless be understood that no limitation of the scope of the invention is thereby intended, such alterations and further modifications in the illustrated device, and such further applications fo the principles of the invention as illustrated therein being contemplated as would normally occur to one skilled in the art to which the invention relates.

Figure 2:
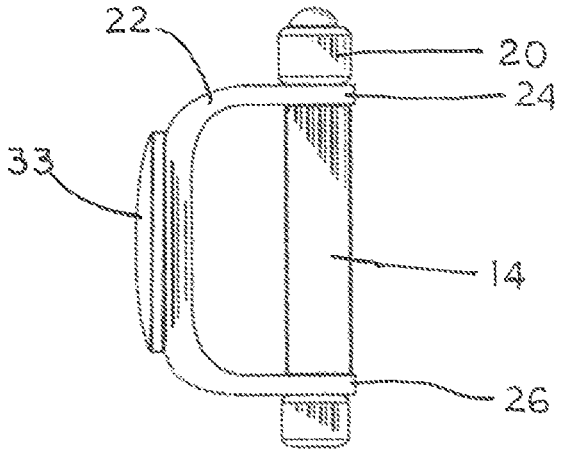
FIG. 2 is a side view of the jump rope handle assembly of FIG. 1.
Figure 3:
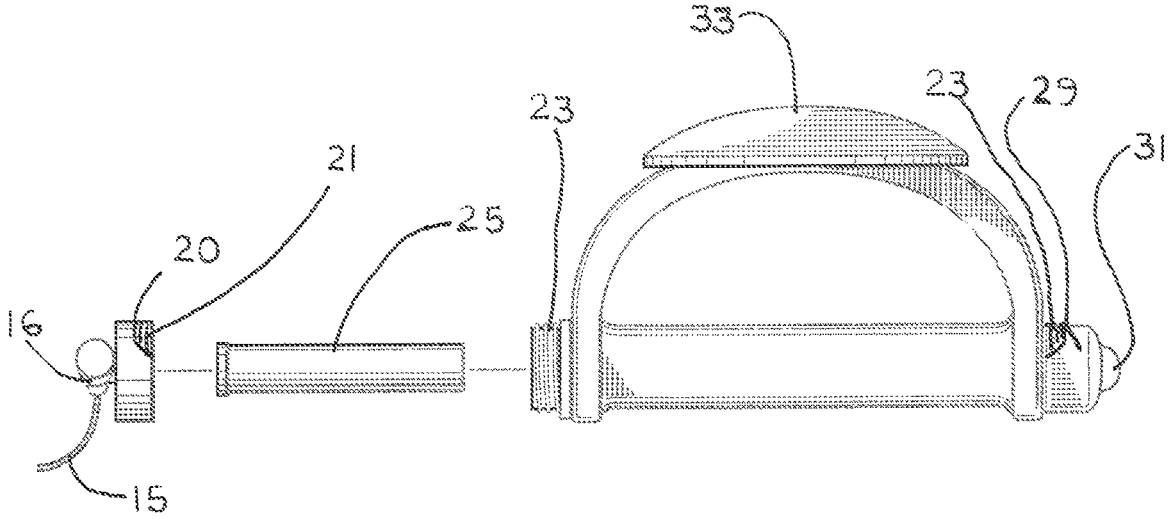
FIG. 3 is an exploded perspective side view of the jump rope handle assembly of FIG. 1 showing the convex push-up disc mounted to the stirrup shaped handle guard, the abdominal bearing member extending from a distal end of the longitudinal handle, the threaded end cap for cooperative engagement with the distal end of the handle and a loop affixed to the end cap for attachment of the jump rope.
Figure 7:
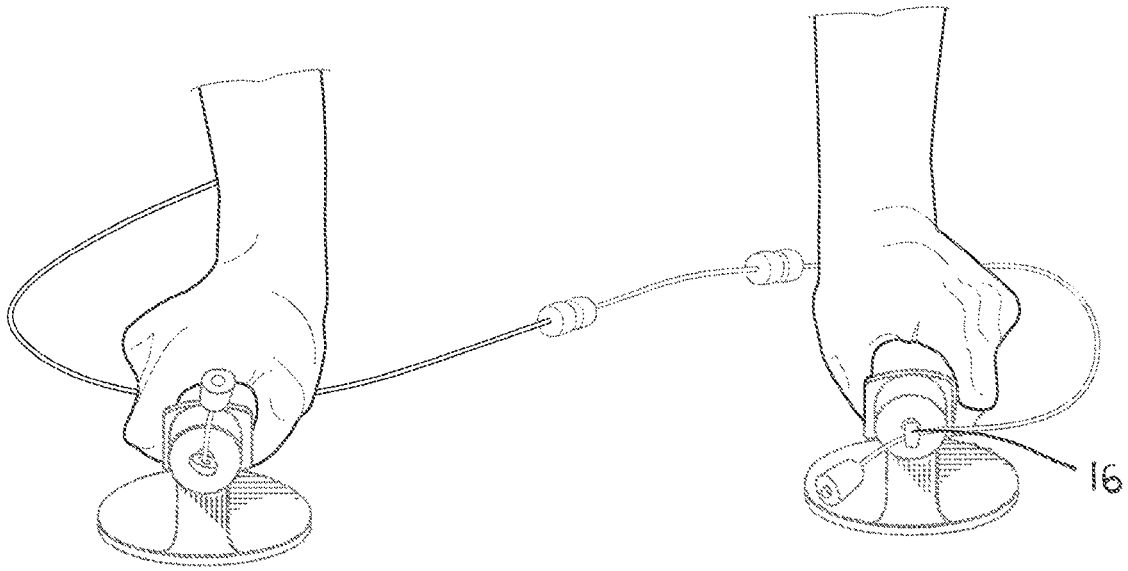
FIG. 7 is a perspective view of the handle assembly of FIG. 1 attached to a jump rope showing the position of the handle assembly during use for push ups with the convex disc member supporting the user.
Figure 4:
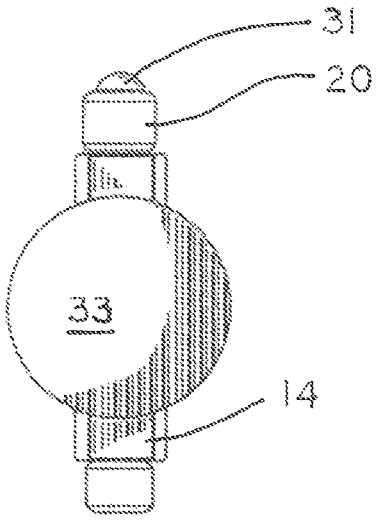
FIG. 4 is a front perspective view of the convex push-up disc mounted to the stirrup handle guard opposite the handle of the handle assembly and showing the abdominal roller member shown in FIG. 1.
Figure 5:
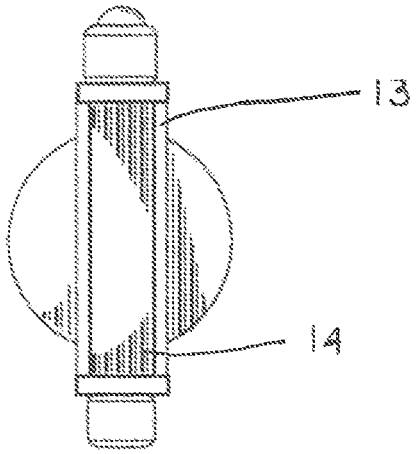
FIG. 5 is a rear perspective view of handle assembly of FIG. 1 showing the convex push-up disc mounted to the stirrup handle guard opposite the longitudinal handle of the handle assembly and showing the abdominal roller member.
Figure 6:
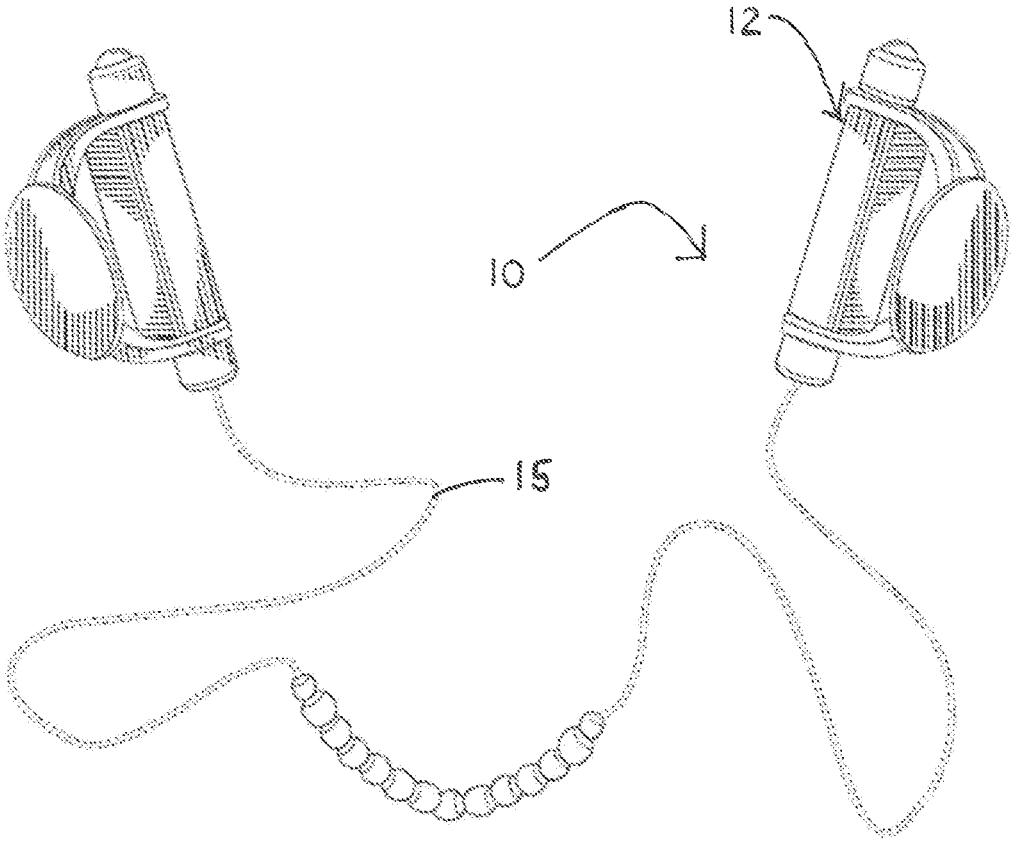
FIG. 6 shows a perspective view of the handle assembly of FIG. 1 attached to a jump rope with the longitudinal handle attaching to the end cap, the abdominal bearing member disposed in the distal end of the longitudinal handle, and the stirrup shaped hand guard having means for affixing a convex shaped base extending opposite the user's wrist and arm for supporting the user during pushups.
Figure 8:
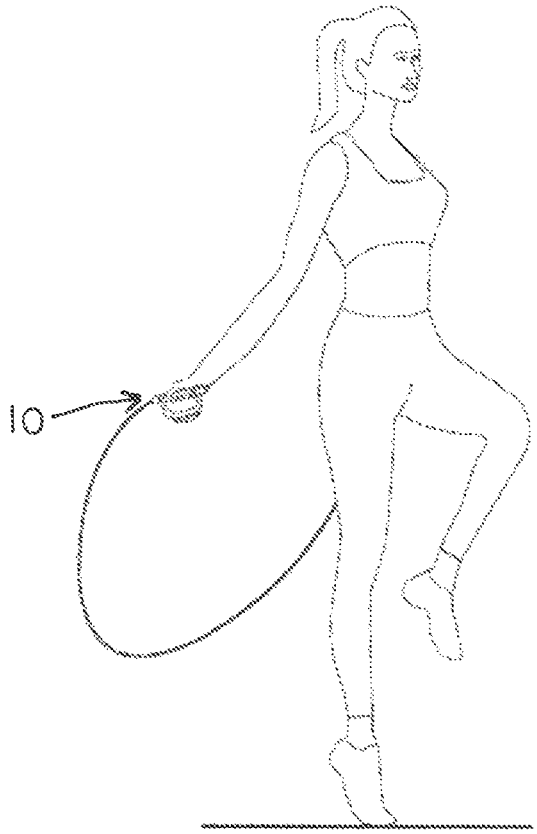
FIG. 8 is a perspective view of the jump rope and handle assembly in use.

As illustrated in FIGS. 1-8, the jump rope and handle assembly 10 includes a pair of longitudinal handles 12 may included a pliable or soft cover 13 covering the generally cylindrical handle body 14 comprising a rubber, plastic, or elastomeric material having memory secured to the handle body by a friction fit. The cover 13 may comprise a soft rubber or other polymer formed in a particular shape to enhance ergonomic grip or comfort. The rope 15 may comprise a polymer, leather, synthetic leather or other flexible material comprising a solid strand or braided material. Means for attachment of a rope such as a ring, loop, prong or an aperture 16 extends from the center of an end cap 20 secured to the hollow longitudinal handle 13 by a friction fit or by cooperative engagement with threads 21 formed in or on threads 23 formed on the distal end of the longitudinal handle and an end cap having matching threads for cooperative engagement therewith. The longitudinal handle 14 may have a cylindrical, rectangular, or ergonomic shaped longitudinal body comprised of a metal, rubber, plastic or elastomer compressible material including a center axial bore hole or hollow body for holding a single longitudinal weight 25 or a plurality of weights such as shots or slugs. An end cap 20 is be fitted over the distal end of the retaining member. The excess portion of the rope can be stored in the hollow portion of the handle. The rope retaining member is affixed to the end cap.

The combination jump rope includes a stirrup handle guard 22 extending around the handle attaching to the handle at the opposing distal ends 24, 26. The handle guard can be removably attached or integrally formed with the handle guard from metal such as stainless steel or aluminum or molded from a polymer such as polyvinyl chloride, polyethylene, fiberglass, aramid fiber or other plastic and combinations thereof. A convex shaped weight 33 of a selected diameter and thickness is attached to the outer surface 27 of the handle guard 22 by means of holding such as a threaded member whereby a screw may extend from the handle guard for threaded engagement with a threaded socket in the rear surface of the weight of a threaded stud may extend from the bottom surface of the weight and threadably engage a threaded bore of the outer surface of the handle guard. The edges of the weight may be threaded around the outer periphery for threaded engagement with a base affixed to the handle clamp, or the weight may also be affixed by a friction fit or snap fit and retained to the handle guard. The weights can include interchangeable convex weight units allowing for various weights to be easily attached or detached from the handles. A novel feature of the weights is that the outer surface is convex shaped providing a base for using the handles for push-ups.

The selected fixed weight or variable-weight convex pushup jump rope does not require a separate locking mechanism to hold weights into place on the handle and allows for the convex shaped weight to be affixed to the outer surface of a stirrup shaped hand guard in order to be used for pushups.

A bearing member 31, such as a ball bearing, may be movably disposed in a socket in the distal ends of the handle, a socket formed in the end cap 29 or in aperture formed in the end cap 29 which is attached to the handle by a friction fit or threaded engagement with threads provided on distal end of the handle providing a means for abdominal muscle exercise. The ball bearing member may be spring loaded, or fixed, and composed of aluminum or stainless steel or from a polymer or material of a selected hardness for massaging the ABS.

The jump rope length is easily adjustable to accommodate each individual user by retracting a portion of the rope inside the hollow rope handles. Retraction is accomplished by the release of a variable-length clamping mechanism. When closed, the clamping mechanism compresses the jump rope cable against a handle end to hold it firmly in place. The locking attachment which holds the weight onto the handle simply relies on friction to hold the weight in place.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

We claim:

1. An exercise and fitness device, comprising:

a pair of longitudinal handles;

each longitudinal handle having a hollow interior and having a first end cap affixed to a first distal end and second end cap affixed to a second distal end;

a jump rope having a first distal end removably retained to said first end cap of each of said longitudinal handles by a retaining means;

a handle guard defining a stirrup having distal ends mounting to opposing distal ends of each of said longitudinal handle;

at least one weight disposed within said hollow interior of each of said longitudinal handle;

removable convex dome shaped disc weight of a selected size or weight affixed to an outer surface of a center portion of said handle guards wherein said convex portion extends outwardly from said handle guards in opposed alignment to said user's wrist and forearm providing a base for using said longitudinal handles for push-ups while attached to said jump rope; and a bearing member extending from said second end cap of each of said longitudinal handle, said bearing member comprising a ball bearing movably disposed in a socket formed said second end cap of said longitudinal handles for exerting pressure on a user's abdominal muscles.

2. The exercise and fitness device of claim 1, wherein said bearing member may be spring loaded or fixed in said second end cap of said longitudinal handle.

3. The exercise and fitness device of claim 1, wherein said retaining means for holding an end of said jump rope to said first end cap end cap of each one of said longitudinal handles is a clamp.

4. The exercise and fitness device of claim 1, wherein said at least one weight includes at least one removable weight disposed within said hollow interior of said longitudinal handles.

5. The exercise and fitness device of claim 1, wherein said jump rope is threaded through a loop formed in said first end of said longitudinal handles.

6. The exercise and fitness device of claim 1, wherein said jump rope is detachable and retractable.

7. The exercise and fitness device of claim 1, wherein said longitudinal handles are covered by a pliable material comprising a rubber material, a plastic material, or an elastomeric material.

8. The exercise and fitness device of claim 1, wherein said longitudinal handles are formed in a particular shape to enhance ergonomic grip or comfort.

9. The exercise and fitness device of claim 1, wherein said rope is selected from the group consisting of a polymer material, a leather material, a synthetic leather material, a solid strand of material, a braided material, and combinations thereof.

10. The exercise and fitness device of claim 1, wherein said removable convex dome shaped disc weight comprises a selected diameter and thickness.

11. The exercise and fitness device of claim 1, wherein said removable convex dome shaped disc weight affixed to an outer surface of said center portion of said handle guards includes a threaded socket in the rear surface of said removable convex dome shaped disc weight for cooperative engagement with a screw extending from said center portion of said handle guards.

12. The exercise and fitness device of claim 1, wherein said removable convex dome shaped disc weight is affixed to an outer surface of said center portion of said handle guards by threaded engagement whereby the edges of said removable convex dome shaped disc weight include threads cooperatively engaging a threaded base extending from said center portion of said handle guards.

13. The exercise and fitness device of claim 1, wherein said removable convex dome shaped disc weight is affixed to an outer surface of said center portion of said handle guards by a friction fit with a base extending from said center portion of said handle guards.

14. An exercise and fitness device, consisting of:

a first longitudinal handle and a second longitudinal handle;

each one of said first longitudinal handle and said second longitudinal handle having a hollow interior and having a first end cap affixed to a first distal end and second end cap affixed to a second distal end;

a handle guard defining a stirrup having distal ends mounting to opposing distal ends each of of said longitudinal handles;

a jump rope having opposing distal ends removably retained to a selected end cap of said first end cap of each of said longitudinal handles by a retaining means;

at least one removable weight disposed within said hollow interior of each of said longitudinal handles;

a removable convex dome shaped disc weight of a selected size affixed to an outer surface of a center portion of said handle guards wherein said convex portion extends outwardly from said handle guards in opposed alignment to said user's wrist and forearm providing a base for using said longitudinal handles for push-ups while attached to said jump rope; and a bearing member extending from said second end cap of each of said longitudinal handles, said bearing member comprising a ball bearing movably disposed in a socket formed in said second end cap of said longitudinal handles for exerting pressure on a user's abdominal muscles by user.

* * * * *